US006163915A

United States Patent [19]

Kaczmarz et al.

[11] Patent Number: 6,163,915

[45] Date of Patent: Dec. 26, 2000

[54] CONTROL SYSTEM FOR FLOOR CARE MACHINE

[75] Inventors: Kenneth A. Kaczmarz, Hoffman Estates; Brock E. Robinson, Naperville; John B. Payson, Bolingbrook; James V. Allen, Lombard, all of Ill.

[73] Assignee: Minuteman International, Inc., Addison, Ill.

[21] Appl. No.: 09/138,822

[22] Filed: Aug. 21, 1998

Related U.S. Application Data

[60] Provisional application No. 60/057,918, Sep. 4, 1997.

[51] Int. Cl.[7] ..... A47L 11/14; A47L 11/28

[52] U.S. Cl. ..... 15/49.1; 15/87; 15/98; 15/320

[58] Field of Search ..... 15/49.1, 50.1, 15/87, 98, 320

[56] References Cited

U.S. PATENT DOCUMENTS

| | | |
|---|---|---|
| 3,129,539 | 4/1964 | Tempero . |
| 3,496,681 | 2/1970 | Oswald . |
| 4,633,541 | 1/1987 | Block . |
| 4,674,142 | 6/1987 | Meili . |
| 5,056,175 | 10/1991 | Stein et al. . |
| 5,177,828 | 1/1993 | Von Vett . |
| 5,253,384 | 10/1993 | Joines et al. . |
| 5,481,776 | 1/1996 | Briscoe . |
| 5,615,437 | 4/1997 | Takahaski . |
| 5,673,450 | 10/1997 | Briscoe . |

FOREIGN PATENT DOCUMENTS

| | | |
|---|---|---|
| 0391457A1 | 10/1990 | European Pat. Off. . |
| 925011A1 | 6/1999 | European Pat. Off. . |
| 2125586 | 3/1999 | Spain . |

*Primary Examiner*—Terrence R. Till
*Assistant Examiner*—Jennifer McNeil
*Attorney, Agent, or Firm*—Emrich & Dithmar

[57] ABSTRACT

A floor care machine such as a burnisher may operate in a manual or automatic mode for controlling the operating pressure of the working unit, such as a brush or pad. The illustrated machine has a motor and pad driver assembly mounted for height adjustment by an actuator. In the automatic mode, a transducer senses motor current (i.e., load) and generates a signal representative of the actual operating pressure exerted by the pad on the floor. A microprocessor-based controller controls the actuator to adjust the height of the pad relative to the floor, and thus adjusts the pad pressure on the floor, according to a setting selected by the operator. The controller is programmed to reduce the effect of "hunting" by entering a Lock Mode after operation has achieved predetermined conditions. System operation remains in the Lock Mode as long as other criteria are met, and operation returns to a Hunt Mode if these other criteria are not met. The operator may enter data into the controller to adjust the sensitivity of the system in the Hunt Mode and the Lock Mode for different applications or floor conditions.

11 Claims, 7 Drawing Sheets

CONTROL SYSTEM FOR FLOOR CARE MACHINE

RELATED APPLICATION

This application claims the benefit of copending U.S. Provisional Application No. 60/057,918, filed Sep. 4, 1997.

FIELD OF THE INVENTION

The present invention relates to floor care machines, and particularly floor polishers, burnishers and scrubbers.

BACKGROUND OF THE INVENTION

The present invention is illustrated and described in terms of a burnisher, but persons skilled in the art will readily appreciate that the principle of the invention is generally applicable to other machines wherein it is desired to control the operating pressure of a floor-engaging work unit such as a brush or pad. The term "operating pressure" refers to the downward force induced by the work unit on the floor being treated.

U.S. Pat. No. 4,674,142 discloses a floor cleaning machine with an electrical motor for controlling the position of a brush head relative to the floor. In one embodiment, a pressure sensing device is mounted on a lever arm for carrying the brush head. A control motor positions a gear block which is connected to the lever by a spring for setting the applicator pressure on the brush head. In a second embodiment, it is suggested that the mounting lever carrying the brush head be set by the control motor by means of pulse width modulation such that "the stall-voltage of the motor means [i.e., the control motor] is maintained at an operator-set value".

SUMMARY OF THE INVENTION

Machines of the type with which the present invention is concerned are typically manufactured for commercial use. For example, such a machine may be a battery-operated, self-propelled automatic floor burnisher. It is typical that such expensive machines are put to widespread use for treating a variety of floor surfaces having widely varying surface conditions. For example, such a machine may be used to polish or burnish floors in a commercial building, and the condition of the floors may range from smooth to uneven.

According to the present invention, a drive motor and a pad driver assembly (or other floor-engaging work unit) are mounted to the frame of a floor care machine such that the pad may be moved vertically by an actuator under control of a microprocessor-based controller.

In the automatic mode, the operator selects a desired operating pressure from a number of available choices by depressing an actuator (switch). When the pad is lowered to a use position, the load current of the drive motor is sensed, and a signal is generated representative of the pressure exerted by the pad on the floor, sometimes referred to as the actual pad pressure, the actual operating pressure, or the applied pressure. As the actual operating pressure increases or decreases, the current of the drive motor increases or decreases accordingly. The load signal is thus representative of the actual operating pressure of the pad. The controller compares the signal representative of actual operating pressure with a stored signal representation of the pressure desired and entered by the operator (called the "set operating pressure" or simply the "set pressure"), and the difference is used to control the actuator to adjust the applied pad pressure to the desired or set level. The machine has a manual mode and an automatic mode. In the manual mode, the operator sets the brush position (i.e. pressure) relative to the support wheels of the machine; and the brush remains in that position until further adjusted by the operator. The applied pressure of the brush may vary with conditions, but some applications will tolerate this variance.

In the automatic mode, the operator has a number of discrete settings for the actual operating pressure of the machine. Moreover, the operator may, under program control adjust the sensitivity of the system to reduce continuously or repeatedly "hunting" of the controller to achieve a precise operating pressure. This sensitivity adjustment enables the machine to operate over uneven surfaces as well as smooth surfaces for a given operating pressure setting in the automatic mode without having the control system constantly change the position of the drive motor and pad assembly to seek a desired operating pressure.

The sensitivity adjustment is accomplished as follows. For each desired operating pressure setting which can be selected by the operator, there is a range of pressure values, called the Operating Pressure Range, which has as a midpoint the operating pressure value selected by the operator (the "set operating pressure"). The system has two operating modes while operating in the automatic mode—a "HUNT" Mode and a "LOCK" Mode.

If the system is operating in the HUNT Mode, an accumulator called the "Stable Timer" is incremented periodically when the actual operating pressure is within the Operating Pressure Range. Conversely, the "Stable Timer" is decremented periodically when the operating pressure is outside the Operating Pressure Range. The contents of the Stable Timer are thus representative of an integrated cumulative value of the time the system has operated in the Desired Pressure Range. The contents of the Stable Timer are compared with the contents of a HUNT Reference Register (sometimes referred to as the "stable reference register"), which contains a predetermined, but settable value. When the contents of the Stable Timer equal the contents of the HUNT Reference Register, the system exits the HUNT Mode and enters the LOCK Mode.

The contents of the HUNT Reference Register may be increased or decreased by the operator under program control. As used herein, the "contents" of the Stable Timer, HUNT Reference Register, Unstable Timer and LOCK Reference Register refer to data representative of a predetermined number or quantity. In the case of the HUNT Reference Register and the LOCK Reference Register, the contents are programmable. This data represents a quantity which may sometimes be referred to as the "size" of a register. A decrease in the contents of the HUNT Reference Register reduces the sensitivity of the system because a smaller number permits the system to enter the LOCK mode more quickly, therefore reducing sensitivity.

In the LOCK Mode, the Controller periodically increments an accumulator called the Unstable Timer when the actual operating pressure is outside the Operating Pressure Range. The Controller periodically decrements the Unstable Timer when the actual operating pressure is within the Operating Pressure Range. If the contents of the Unstable Timer reach a predetermined value, indicating that the actual operating pressure has deviated over time from the Operating Pressure Range beyond a pre-set value, the Controller exits the LOCK Mode and re-enters the HUNT Mode, thereby enabling the actuator to adjust the height of the pad, and thus the actual operating pressure. Operation proceeds as described above for the HUNT Mode.

As a safety measure, a limit switch detects the position of the pad and prevents operation of the drive motor unless the pad driver is below a predetermined level which defines the upper limit of the use range. This prevents inadvertent operation of the pad driver when the drive motor and pad driver assembly is raised for transport, for example, or for purposes of changing the brush or pad.

Other features and advantages of the present invention will be apparent to persons skilled in the art from the following detailed description of a preferred embodiment accompanied by the attached drawing wherein identical reference numerals will refer to like parts in the various views.

DETAILED DESCRIPTION OF A PREFERRED EMBODIMENT

Figure 1:
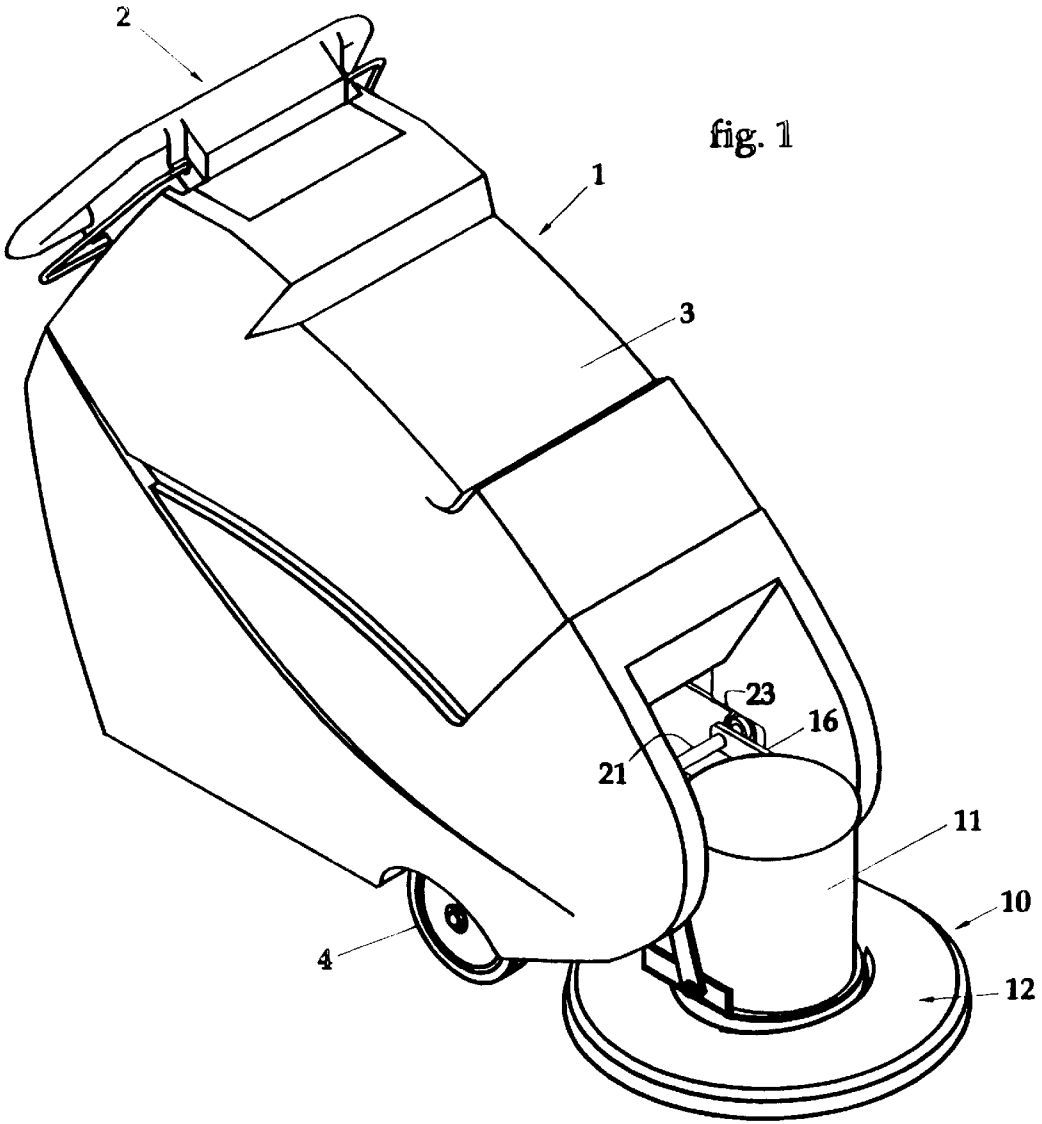
FIG. 1 is an upper, right frontal perspective of a floor burnisher incorporating the present invention.

Turning first to FIG. 1, reference numeral 1 generally designates a floor burnishing machine which includes an operator's station and handle generally designated 2, an outer housing 3, and pairs of front and rear support wheels, one of the front wheels being shown in FIG. 1 and designated 4. A rear wheel 5 is shown in FIG. 2.

At the front of the machine there is mounted a drive motor and pad assembly generally designated 10 and including a pad drive motor 11 and a cover 12. A pad 13 (FIG. 2) and a pad driver 14 are mounted beneath the cover 12 to the shaft of motor 11. Although the present invention is illustrated in the form of a burnisher, persons skilled in the art will appreciate that the invention may be used in other floor care machines, such as polishers and scrubbers. Typically, floor burnishers of this type are battery-powered for mobility and convenience; and a separate motor (not shown) drives the front wheels 4 under operator control.

Figure 2:
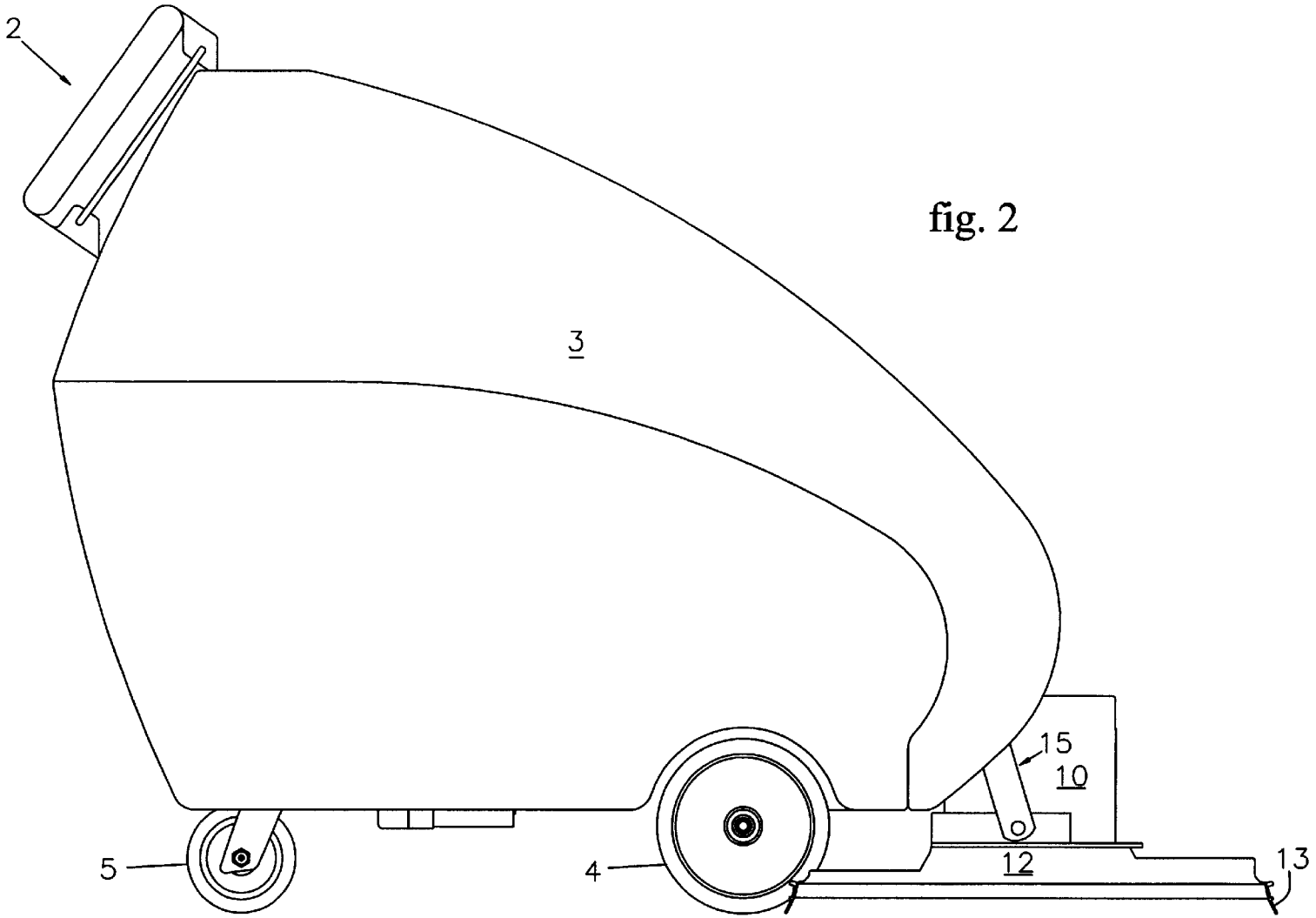
FIG. 2 is a right-side view of the machine of FIG. 1.
Figure 3:
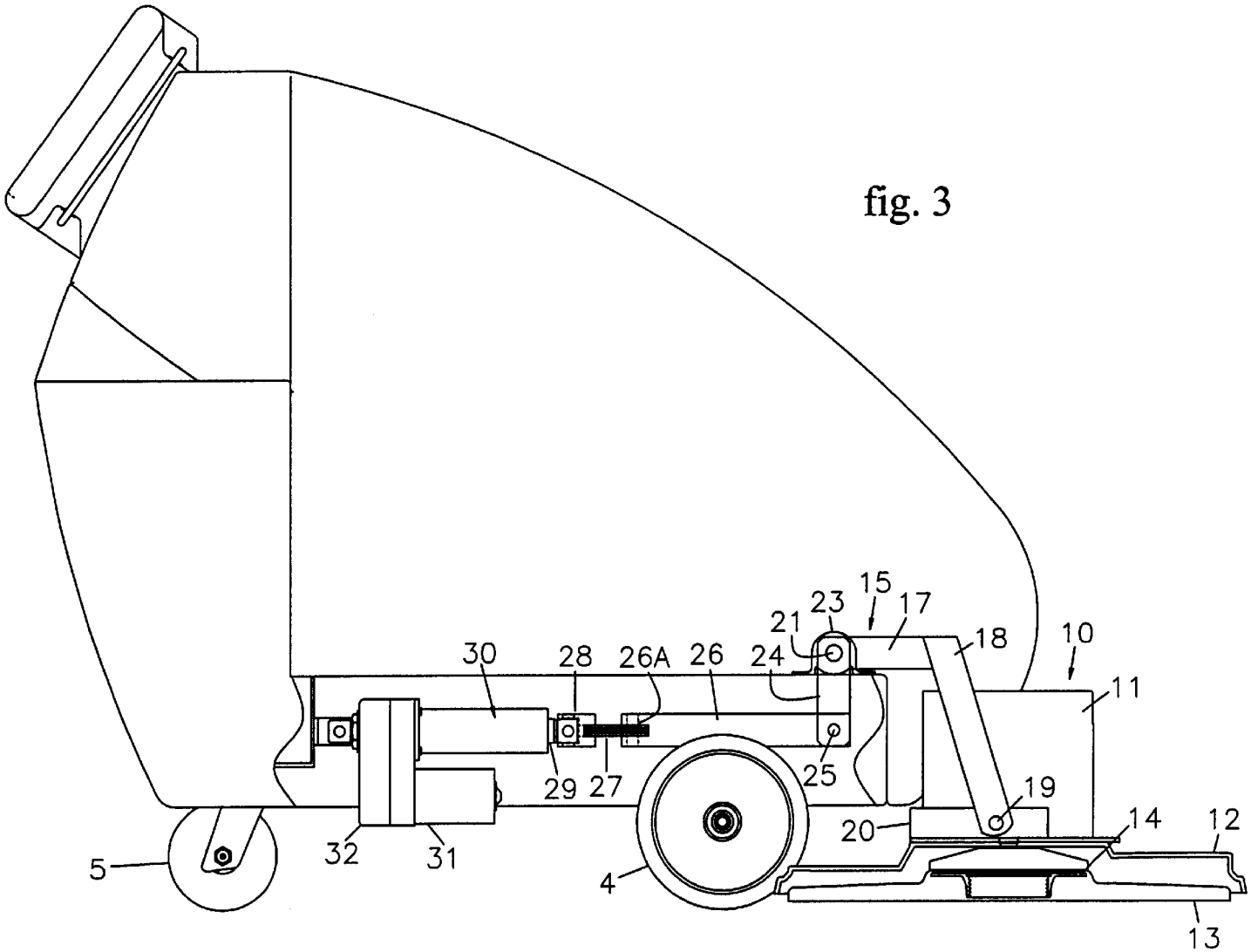
FIG. 3 is a diagrammatic side view similar to FIG. 2 showing the linear actuator, lift linkage and drive motor and pad assembly mounted to the machine.

Referring now to FIG. 2, the driver motor 11 is supported by a pair of lift linkages 15, 16, the left linkage 16 being shown in FIG. 1. Each of the lift linkages is in the form of a dog leg, as best seen for the right side lift linkage 15 in FIG. 3, including a horizontal, forwardly extending portion 17 and a downwardly and slightly forwardly extending portion 18. The lower end of the downwardly, forwardly extending link 18 is pivotally connected at 19 to a mounting support 20 for the drive motor 11. The other side of the motor 11 is similarly pivotally mounted to the lower end of the left lift linkage 16 so that the motor and pad assembly 10 is able to adjust to the floor surface by pivoting about a horizontal axis transverse of the direction of travel, and defined by the two pivots connecting the motor and pad assembly to the lift linkages.

The two lift linkages 15, 16 are mounted to a common pivot shaft 21 which is, in turn, mounted to the frame of the machine by a pair of side bearings designated 23, the left one of which is seen in FIG. 1 and the right one in FIG. 2.

A lever arm 24 has its upper end rigidly mounted to the center of the shaft 21, and its lower end pivotally mounted at 25 to a U-shaped extension link 26. The rear of the extension link 26 carries a nut 26A which is received on a threaded shaft 27 secured at its left end in a bracket 28. The bracket 28, in turn, is mounted to the forward end of a shaft 29 of a linear actuator 30. The linear actuator 30 is of conventional design, including a motor 31 and gears 32 to rotate an externally threaded inner shaft telescopically received in shaft 29 which is an internally threaded tubular sleeve so that as the inner shaft is rotated in one direction shaft 29 extends. When the internal shaft is counter-rotated, the shaft 29 retracts. Thus the link 26 moves forwardly when the shaft 29 is extended to rotate the pivot shaft 21 in a counterclockwise direction to raise the motor and pad assembly 10 by means of the pivots 19.

Conversely, as the internal shaft is rotated in the opposite direction, the sleeve shaft 29 is retracted and the extension link 26 is moved toward the rear of the machine, thereby pulling the lever arm 24 toward the rear and rotating the pivot shaft 21 in a clockwise direction to lower the motor and pad assembly 10. The linear actuator thus permits adjustment of the operating pressure of the work unit.

Figure 4:
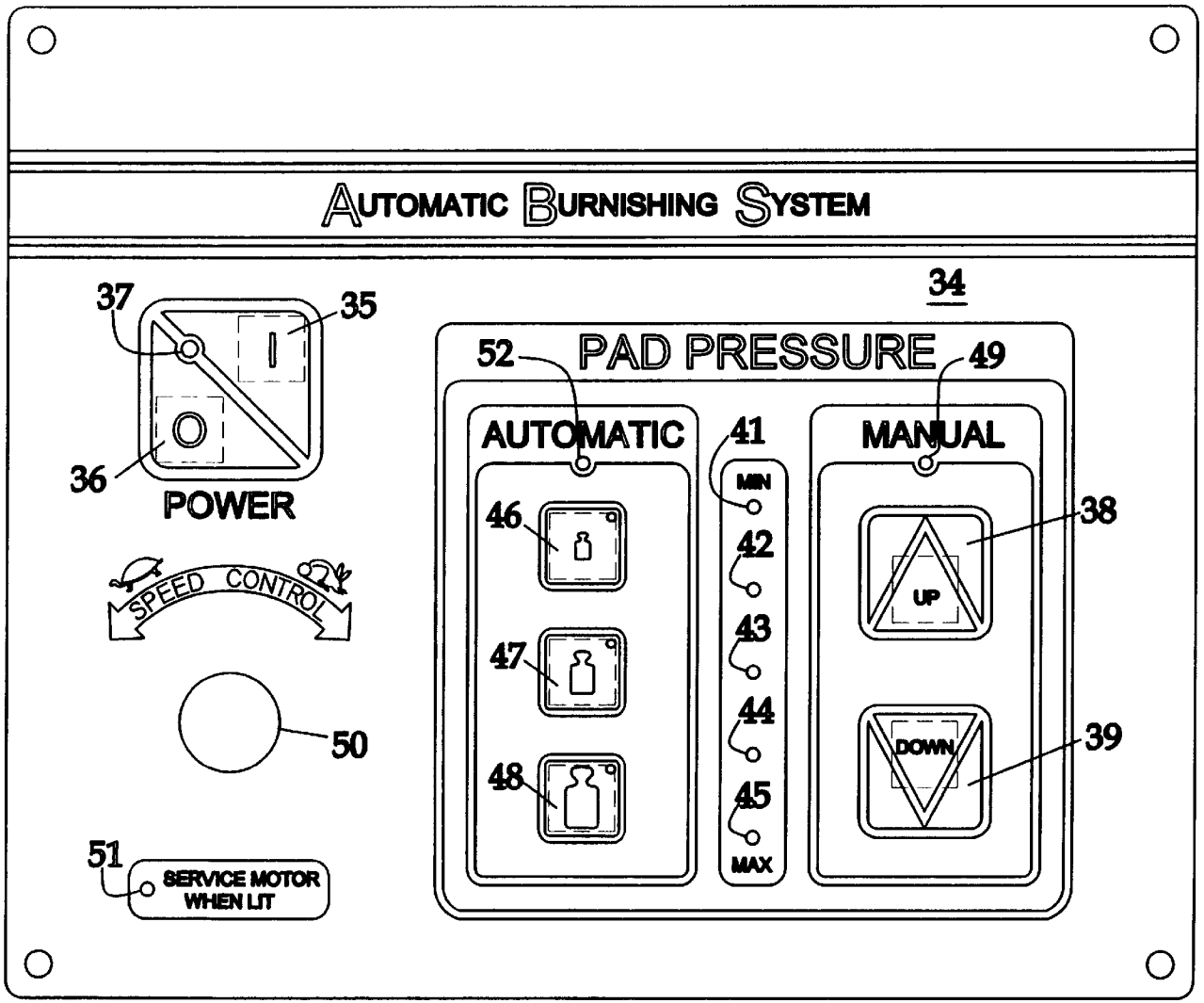
FIG. 4 is an elevational view of the control panel of the machine of FIG. 1.

Turning now to FIG. 4, a control panel 34 is located at the operator station on the machine between the two handles or grips. A first touch actuator (i.e. switch) 35 applies power to the machine, when pressed by the operator; and a second touch actuator 36 shuts the machine off. An LED (Light Emitting Diode) indicator 37 is lit when the machine is energized.

On the right-hand portion of the control panel, manual control is exercised by touch-actuated switch 38 which energizes the actuator motor 31 to extend the shaft 29 and raise the motor and pad assembly 10. Another touch-actuated switch 39 reverses the polarity of power to the actuator motor 31 and causes the motor and pad assembly 10 to be lowered.

To the left of the switches 38, 39 are a series of five LEDs 41, 42, 43, 44 and 45 which comprise a display representing a range of operating pressures which are being exerted by the brush on the surface being treated. In the illustrated embodiment, for example, minimum pressure is being exerted when the LED 41 is lit, a greater operating pressure is being exerted when LED 42 is lit, and so on. If LED 45 is lit, the operating pressure on the surface being treated is at a design maximum. The indicators 41–45 are arranged in a vertical line to represent the action of the brush, and the simulated graph represented by the LEDs is representative of increasing downward movement, and thus increased operating pressure exerted by the brush on the floor to give the operator a graphical representation of the relative position of the brush.

To the left of the indicator segment just described there are three additional touch-actuated switches designated respectively 46, 47, and 48 and permitting operation in an automatic mode. That is, switches 46–48 represent operation for three pre-selected operating pressures (the "set" pressure) exerted by the brush, as will be more fully described. Persons skilled in the art will appreciate that the number of pre-selected operating pressure is a matter of design preference. Briefly, when switch 46 is actuated, the controller sets the system to operate at lowest operator-selected set pressure. When the switch 47 is actuated, a greater operating pressure is exerted by the brush on the surface being treated, and maximum pre-selected operating is exerted when the switch 48 is pressed by the operator. The system could include a larger or smaller number of operator-selected set pressures, as will be better appreciated from subsequent description.

Reference numeral 50 indicates a speed control knob for controlling the speed of the traction drive for driving the front wheels 4. The traction speed control system of the present invention is conventional and need not be described further. If the brushes on the main traction motor become worn, a voltage is sensed across the brush terminals and if the sensed signal exceeds a predetermined value, representative of the fact that the brushes are worn and should be replaced, then LED 51 is lit to alert the operator.

If the operator selects either the UP switch 38 or the DOWN switch 39, an LED indicator 49 is lit to indicate to the operator that operation is in a manual mode. Similarly, if the operator actuates one of the switches 46–48 to select a desired operating pressure, then LED 52 is lit to indicate that the machine is operating in the "automatic" mode.

Figure 5:
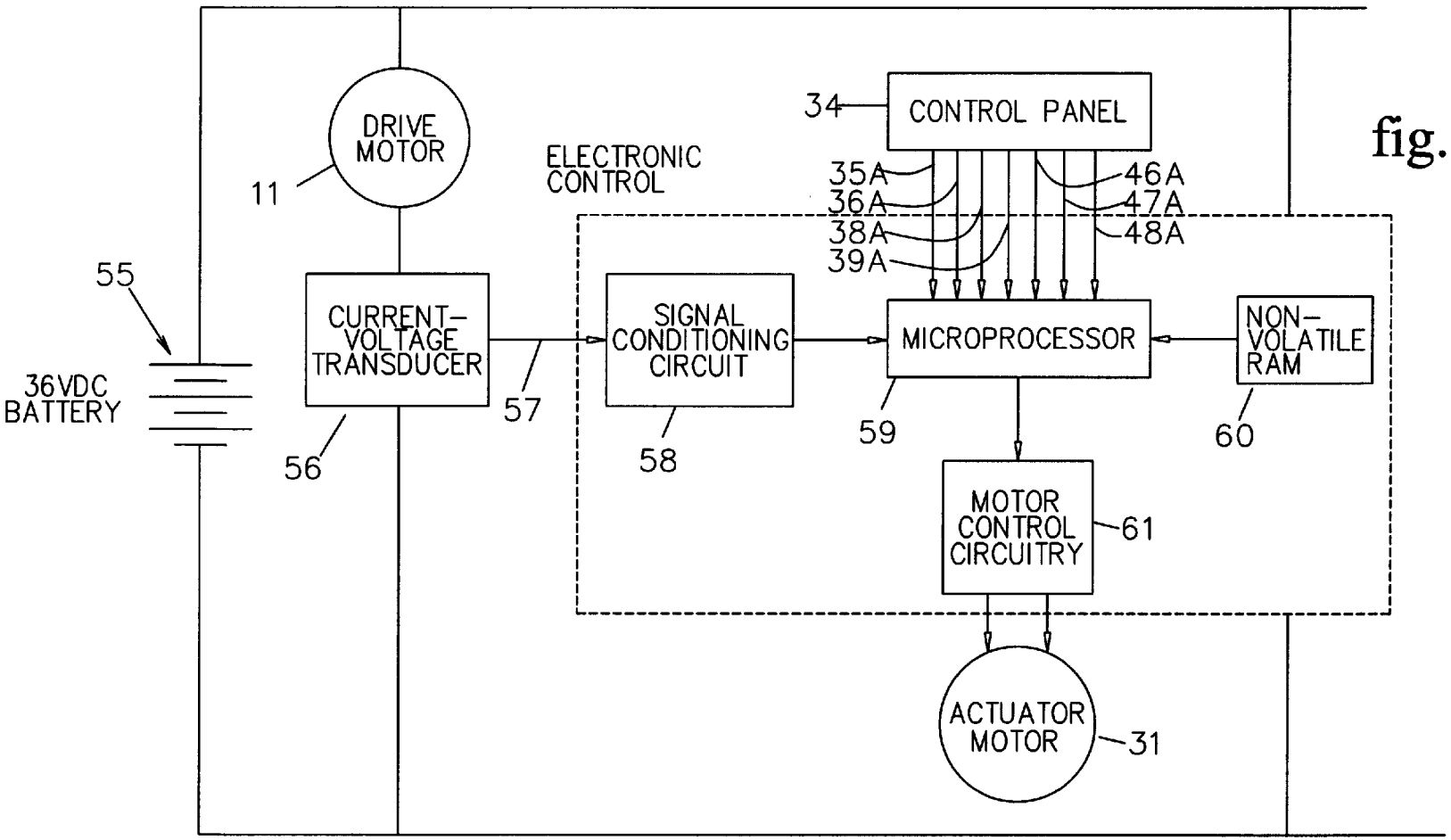
FIG. 5 is a functional block diagram of the control system for the machine of FIG. 1.

Turning now to FIG. 5, there is shown a schematic diagram of the control system. As mentioned, the illustrated embodiment of the invention is powered by batteries as distinguished from being plugged into a wall outlet using a long extension cord. The drive motor 11 for the pad driver is shown diagrammatically. The system batteries are shown diagrammatically as a single battery generally designated 55. The pad drive motor 11 (which may be a 36-volt, DC permanent magnet motor) is connected in series with a current-to-voltage transducer 56, sometimes referred to as a "shunt". It is a conventional DC current measuring device which generates a voltage signal on a line 57 which is representative of load current flowing through the drive motor 11; thus, the signal represents actual applied pressure of the work unit (the "operating" pressure).

The voltage output signal from the transducer 56 is coupled to a signal conditioning circuit 58, the output of which is a digital signal representative of the drive motor load current, and thus, the operating pressure. The output signal of the signal conditioning circuit 58 is fed to a programmable microprocessor 59.

The microprocessor 59 also receives signals from the control panel 34 as follows: On line 35A a signal is received from the "ON" switch 35; on line 36A, a signal is received from the "OFF" switch 36; on line 38A, a signal is received from the "UP" switch 38; on line 39A, a signal is received from the "DOWN" switch 39; on line 46A, a signal is received from the "LIGHT PRESSURE" switch 46; on line 47A, a signal is received from the "MEDIUM PRESSURE" switch 47; and on line 48A, a signal is received from the "HEAVY PRESSURE" switch 48.

The microprocessor also is coupled to a non-volatile random access memory 60 which stores certain of the system parameters and operator-set values which are not lost should the system lose power. For example, the settings for the "LIGHT PRESSURE", "MEDIUM PRESSURE", and "HEAVY PRESSURE" as well as the operator-adjusted values for the HUNT Reference Register and the LOCK Reference Register may be stored in the non-volatile memory 60, so the data can be recovered when power is restored and the microprocessor re-initializes itself.

The output of the microprocessor 59 is fed to conventional motor control circuitry 61 for controlling the previously described actuator motor 31. Preferably, the motor control circuitry 61 includes field effect transistors for powering the motor 31 in forward and reverse and for controlling its speed, under direction from the microprocessor 59. The motor control circuitry 61, as mentioned, includes Pulsed Width Modulation control for the actuator motor. This enables the microprocessor to control the duty cycle of the power driving the actuator motor 31 to control its speed. Speed control of motors by pulse width modulation is conventional, and though not essential to the performance of the present invention, it is preferred. Briefly, pulse width modulation control of the actuator motor enables the controller to control the speed of the actuator motor. For example, a duty cycle of 100% is full speed; a duty cycle of 50% is half speed, and so on.

The Controller determines the difference between the sensed actual operating pressure, determined by the current-to-voltage transducer 56, and the operating pressure selected by the operator (called the "set operating pressure"), and then controls the speed and position of the actuator motor accordingly.

For relatively large differences between sensed or actual operating pressure and the set operating pressure in the automatic mode, the controller will increase the speed of the actuator motor 31. This adjusts the motor and pad assembly more quickly when the actual operating pressure is further from the set operating pressure, and permits the system to achieve the desired pressure level more quickly. As the difference between the actual operating pressure and the set pressure decreases, the speed of the actuator motor is reduced. In short, as the actual operating pressure approaches the set operating pressure, the actuator motor, and thus the adjustment of the pad driver, slow down. This reduces the overshoot and undershoot of the system in seeking the set pressure. Thus, the "hunting" of the system to achieve a desired setting is reduced.

Overview of Operation

In operation in the automatic mode, as determined by the operator by depressing one of the three switches 46, 47 or 48, a desired (i.e., "set") value of operating pressure is retrieved by the microprocessor from memory and entered into a register, referred to as the HUNT Reference Register or Stable Reference Register (FIG. 6), for comparison. The signal generated by the current-to-voltage transducer 56 (referred to as the actual or sensed pressure signal or level) is converted to a digital signal in the signal conditioning circuit 58 and then stored in a register in the processor 59 to be compared with the value of the data representative of the set operating pressure chosen by the operator, depending on which of the automatic mode switches 46, 47 or 48 was depressed by the operator.

Operation and Programming of the HUNT Mode

In describing the programming of the machine, it will be helpful to understand that there are two different modes of operation in the automatic mode. The first operating mode is referred to as the HUNT Mode. In this mode, the controller attempts to position (i.e., by raising and lowering) the work unit (i.e., the pad or other work unit) to achieve the desired operating pressure set by the operator. If the sensed actual operating pressure is lower than the operator-set value, the working tool is too high and must be moved lower. Conversely, if the sensed actual operating pressure is greater than the set value chosen by the operator, the working tool is too low and must be raised.

As with all feedback control systems, there is a tendency for the system to "HUNT" around a predetermined target value. Very seldom does the actual control variable equal the set value, and even then, only momentarily. This is particularly true in a system of the nature of the instant system because of the widely varying conditions that may be encountered by the work unit, even over short distances or times, in floor care. That is, the condition of the floor can vary widely even over a short distance. It is therefore desirable to achieve the set pressure within an acceptable pressure range and an acceptable amount of time. The present system allows the operator to select the amount of time that the actual operating pressure must be within a predetermined range of the set pressure. This range is called the Operating Pressure Range. In short, the Operating Pressure Range is the range of actual sensed operating pressures which, if achieved in accordance with an algorithm to be described below, will cause the control system to exit the HUNT Mode and to enter a "LOCK" Mode. In the LOCK Mode, the operating pressure is continued to be sensed, but the system does not exit the LOCK Mode and return to the HUNT Mode unless the deviation of the sensed operating pressure outside the Desired Pressure Range, accumulated over time, exceeds a second predetermined value.

In the HUNT Mode, it is intended that the system not enter the LOCK Mode every time the sensed actual operating pressure enters the Operating Pressure Range. To accomplish this, the sensed actual operating pressure is compared with the value of set operating pressure, which is the mid-point of the Operating Pressure Range for the pressure level selected by the operator in the automatic mode. If the difference between the actual operating pressure and the set pressure is within the Operating Pressure Range, a register is incremented. This register, referred to as the Stable Timer, operates as an accumulator. The Stable Timer is decremented periodically if the operating pressure is outside the Operating Pressure Range. The contents of the Stable Timer therefore represent an integrated or accumulated value of time intervals in which the actual operating pressure is within the Desired Operating Range. The contents of the Stable Timer are compared with the contents of an HUNT Reference Register, the contents of which may be adjusted by the operator. If the contents of the Stable Timer exceed the value stored in the HUNT Reference Register for the HUNT Mode, then the HUNT Mode is exited and the system enters to the LOCK Mode, and adjustment of the actuator stops. This indicates that the system has been operating within the desired pressure range and has achieved an acceptable level of stability.

The operator may program the contents of the HUNT Reference Register by first simultaneously depressing touch switches 36, 38 and 39. The microprocessor senses this combination of signals and enters a Program HUNT Register mode. The operator then actuates switches 35 and 48 simultaneously which causes the system to exit the mode if it had been in the LOCK Mode, and to enter the HUNT Mode. At the same time, the microprocessor actuates one of the LEDs 41–45 to signify to the operator the "size" or value of the contents of the HUNT Reference Register. The HUNT Reference Register is an internal register which stores data representative of a predetermined value. The operator can increase the "size" (i.e., the magnitude) of the data signal stored in the HUNT Reference Register by actuating switch 38. Conversely, the operator may decrease the size or value of the data stored in the HUNT Reference Register by depressing switch 39. As the value of the contents of the HUNT Reference Register increases, the LED 44 may be lit, and then, when the contents of the HUNT Reference Register are at a maximum, the LED 45 will be lit. Conversely, as the size of the HUNT Reference Register is reduced or decremented, the LED 42, and then the LED 41 will be lit when the size of the LOCK Reference Register is at a minimum. The smaller the value of the contents of the HUNT Reference Register, the shorter will be the time that the system spends in the HUNT Mode before exiting to the LOCK Mode, and the greater will be the system sensitivity.

In the LOCK Mode, it is also intended that the system not exit the LOCK Mode every time the sensed actual operating pressure is outside the Operating Pressure Range. To accomplish this, the sensed actual operating pressure is again compared with the set operating pressure. If the difference between the actual operating pressure and the set value is outside the Operating Pressure Range, a register operating as an accumulator, and referred to as the Unstable Timer, is incremented. The Unstable Timer is decremented periodically if the operating pressure is within the Operating Pressure Range. The contents of the Unstable Timer therefore represent an integrated or accumulated value of time intervals in which the operating pressure is outside the Desired Operating Range. The contents of the Unstable Timer are compared with the contents of a LOCK Reference Register, or unstable reference register, as it is sometimes referred to, the contents of which may be programmed by the operator. If the contents of the Unstable Timer exceed the value stored in the LOCK Reference Register for the LOCK Mode, then the LOCK Mode is exited and the system returns to the HUNT Mode so that the operating pressure can be adjusted.

The operator may program the contents of the LOCK Reference Register by first simultaneously depressing touch switches 36, 38 and 39. The operator then actuates switches 35, 46 and 47 simultaneously which causes the system to enter a Program LOCK Reference Register Mode. At the same time, the microprocessor actuates one of the LEDs 41–45 to signify to the operator the "size" or value in the LOCK Reference Register. The LOCK Reference Register is an internal register which stores data representative of a predetermined value. The operator can increase the "size" (i.e., the magnitude) of the data signal stored in the LOCK Reference Register by actuating switch 38. Conversely, the operator may decrease the size or value of the signal stored in the LOCK Reference Register by depressing switch 39. As the value of the LOCK Reference Register increases, the LED 44 may be lit, and then, when the contents of the LOCK Reference Register are at a maximum, the LED 45 will be lit. Conversely, as the size of the LOCK Reference Register is reduced or decremented, the LED 42, and then the LED 41 will be lit when the size of the LOCK Reference Register is at a minimum. The smaller the value of the signal in the LOCK Reference Register, the shorter will be the time that the system spends in the LOCK Mode before exiting to the HUNT Mode, and thus, the greater will be the sensitivity of the system. Conversely, the system will be less sensitive to variations in actual operating pressure if the contents of the LOCK Reference Register are greater.

Flow Chart

Figure 6:
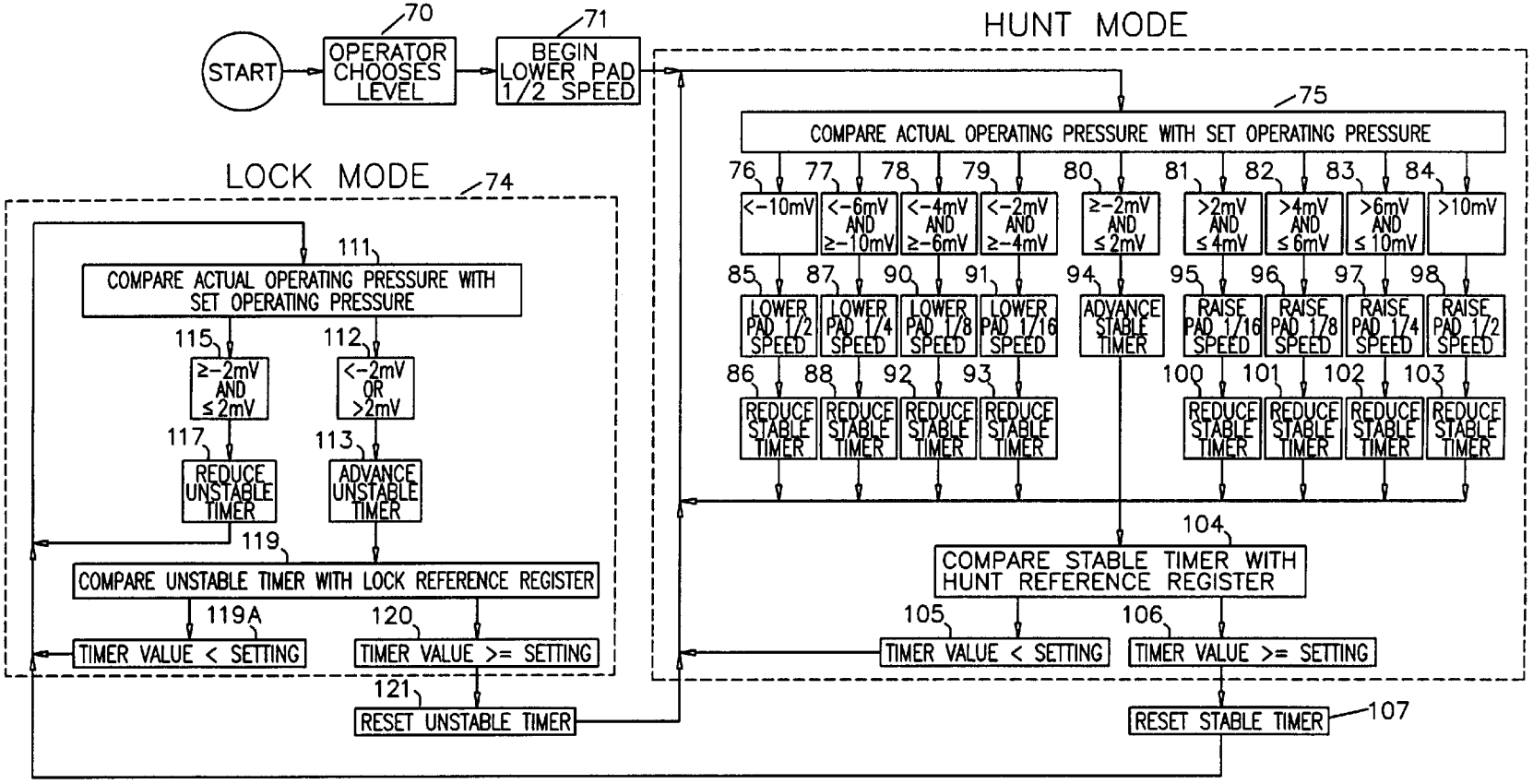
FIG. 6 is a flow chart illustrating the operation of the programmable controller in the control system.

Turning now to the flow chart of FIG. 6, operation in the Automatic Mode begins when the operator chooses a set operating pressure by pressing one of the three switches 46, 47 or 48 on the panel 34 of FIG. 4. This is represented by the block 70 in FIG. 6. The microprocessor immediately begins to lower the motor and pad assembly 10 at a programmed speed of one-half the maximum operating speed of the actuator motor 31, as represented by block 71.

It is assumed in the flow chart of FIG. 6 that the operator has already programmed the contents of the HUNT Reference Register and the LOCK Reference Register to adjust the sensitivity of the system. The register forming the Stable Timer is periodically incremented or decremented or left unchanged, according to an algorithm to be described. In the HUNT Mode, the accumulated contents of the Stable Timer are compared with the contents of the HUNT Reference Register to determine whether the system remains in the HUNT Mode or enters the LOCK Mode. The register is referred to as a "timer" because it is intended, according to the system design as will be understood from the following description, that over a period of time the actual operating pressure will become stabilized and the system can exit the HUNT Mode represented by the dashed block 73 and enter the LOCK Mode 74.

When the motor and pad driver assembly 10 are lowered to a certain level (as determined by a limit switch sensing the position of the motor and pad driver assembly 10), the program enters the HUNT Mode 73. The system first reads the voltage from the current-to-voltage transducer 56 as represented in block 75, and then compares that signal to a second, internally stored reference signal representative of the Set Operating Pressure. The Set Operating Pressure is the midpoint of the Operation Pressure Range, and is a setting selected by the operator (as determined by the switches 46, 47 or 48).

This comparison then generates a difference signal representative of or proportional to the difference between the actual operating pressure sensed by transducer 56 and the Set Operating Pressure chosen by the operator. Depending upon the value of the difference, the system enters one of the blocks 76–84. If the difference signal is a comparatively large negative number, representing that the actual operating pressure is substantially less than the Set Operating Pressure, the microprocessor transmits signals to the motor control circuitry 61 to lower the pad at one-half the maximum operating speed of the actuator, as represented by block 85. Since, in this condition, the actual operating pressure is outside the Operating Pressure Range (represented in this example by the values −2 mV through +2 mV as indicated by the arrow D in graph 1 of FIG. 7), the accumulated value of the Stable Timer is reduced or decremented in block 86.

Similarly, if the difference signal between the actual operating pressure and Set Operating Pressure is greater than or equal to −10 mV, but less than −6 mV (block 77), the pad is lowered at one-quarter speed, as represented by block 87, and the Stable Timer is again decremented as represented by block 88. Similarly, if the different signal is within the range identified in blocks 78 or 79, the pad is lowered at speeds respectively of one-eighth and one-sixteenth of the maximum actuator speed, represented by blocks 90, 91, and the Stable Timer is again decremented as represented by the blocks 92, 93, respectively. If the difference signal is greater than or equal to −2 mV but less than or equal to +2 mV, that is, it is within the Operating Pressure Range, as represented by block 80, then the Stable Timer is advanced or incremented, as represented by the block 94. For each of the blocks 81–84, which represent different signals indicating that the actual operating pressure is progressively greater than the Set Operating Pressure, the pad is raised respectively at speeds of one-sixteenth, one-eighth, one-fourth or one-half maximum speed, as represented by the blocks 95, 96, 97 and 98, respectively. In each case, the Stable Timer is again decremented, as represented by the blocks 100, 101, 102 and 103, respectively because the actual operating pressure is not within the Operating Pressure Range.

Each time the system is operating within the Operating Pressure Range the Stable Timer is incremented (block 94), and the contents of the Stable Timer and the Hunt Reference Register (which is also called the Stable Reference Register) are compared in block 104. The contents of the Hunt Reference Register is the data set by the operator which determines the sensitivity of the system in the Hunt Mode. If the contents of the Stable Timer are less than the setting in the Hunt Reference Register, as represented by block 105, the program loops back to the beginning of the HUNT Mode. If the accumulated value stored in the Stable Timer equals or exceeds the setting of the Hunt Reference Register, as represented by block 106, the HUNT Mode is exited, the Stable Timer is reset as indicated by block 107, and the LOCK Mode is entered.

Turning now to the operation in the LOCK Mode, included within the dashed block 74, the microprocessor continues to read the output signal of the signal conditioning circuit and compares that data (stored in an Unstable Timer and representative of the actual operating pressure) with data stored in an internal register which are representative of the Set Operating Pressure chosen by the operator as represented by block 111. In the LOCK Mode, the microprocessor does not raise or lower the pad driver, so operation is simplified as compared with the HUNT Mode. If the microprocessor determines that the signal difference is not within the Operating Pressure Range, as indicated above, as indicated in block 112, then the microprocessor increments (i.e. advances) the Unstable Timer as indicated in block 113.

If, on the other hand, the difference signal determined in block 111 indicates that the actual operating pressure of the pad is within the Operating Pressure Range, as represented by block 115, then, in block 117, the Unstable Timer is reduced or decremented, and the program returns to block 111 to continue monitoring the actual operating pressure.

The Unstable Timer, like the Stable Timer described above, is a separate register serving as an accumulator or integrator within the memory of the microprocessor.

In block 119, the microprocessor compares the contents of the Unstable Timer with the contents of the Hunt Reference Register (sometimes called the Unstable Reference Register) which stores a value representative of the sensitivity of the system in the Lock Mode, as chosen by the operator. If the contents of the Unstable Timer exceeds the value of the Lock Reference Register, as indicated in block 120, the LOCK Mode 74 is exited, the Unstable Timer is reset in block 121 and the system enters the HUNT Mode, commencing the operation in block 75.

If, on the other hand, the contents of the Unstable Timer are less than the contents of the Lock Reference Register (block 119A), the microprocessor continues to cycle in the LOCK Mode, repeating the operation in block 111.

Figure 7:
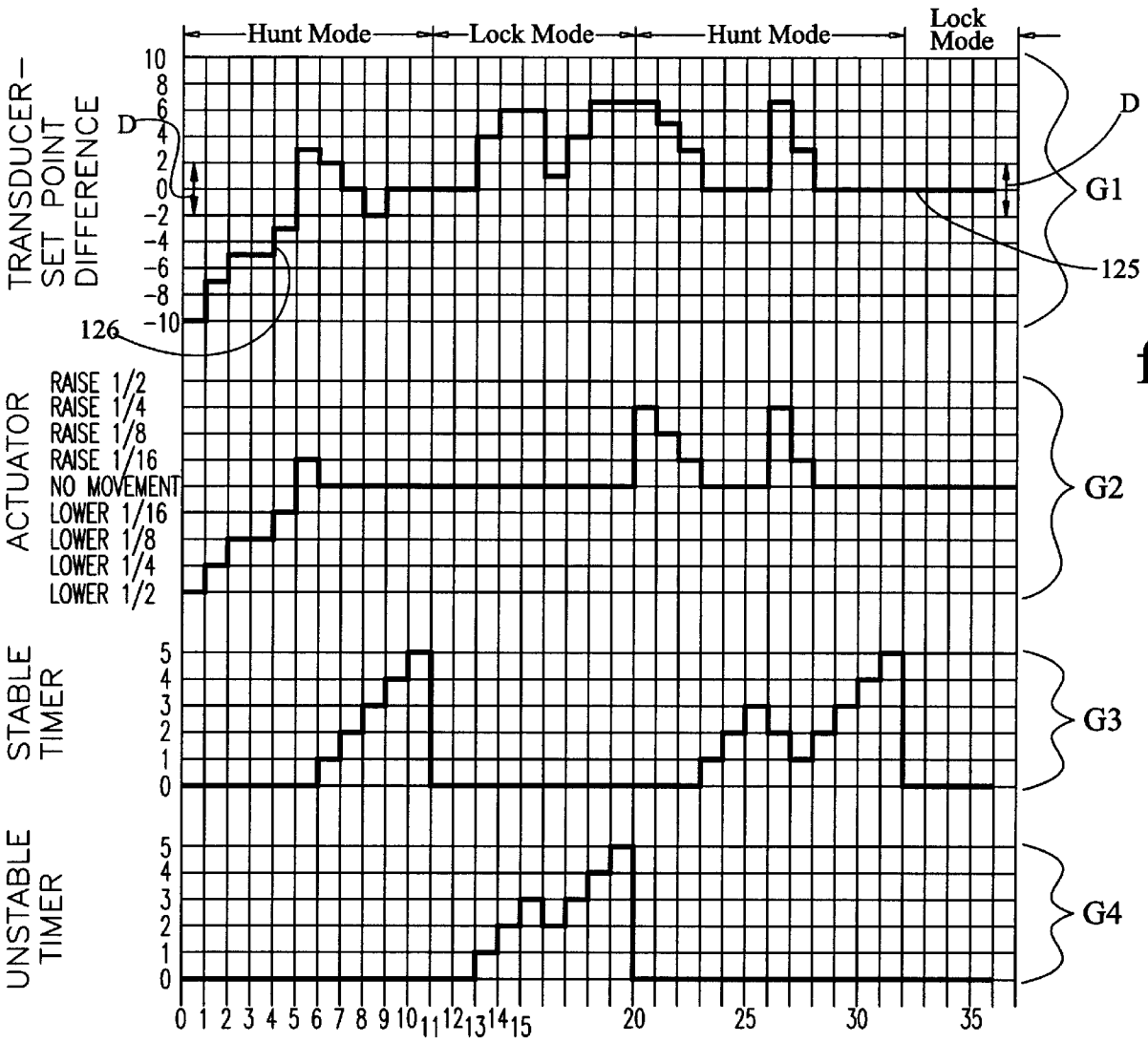
FIG. 7 is a timing diagram illustrating various operating modes of the system.

Turning now to the timing diagram of FIG. 7, there are shown signals representing various system parameters described above for the purpose of illustrating the operation of the system. The first or top graph represents, in graphic form, the determination made by the microprocessor in blocks 75 and 111 of FIG. 6. In FIG. 7, G1, reference numeral 125 represents the condition when the actual operating pressure sensed by the transducer is equal to the set operating pressure—that is, a signal representative of the mid-point of the operating pressure setting selected by the operator.

The graph 126 represents the value of the difference signal determined by the microprocessor—that is, the difference between the signal from the transducer representing actual operating pressure, and the value of the set operating pressure selected by the operator. The graphs of FIG. 7 are divided into three modes, for illustrative purposes, which can be determined from the top of the graph. These include a HUNT Mode (comprising time increments t0–t11, see the bottom of chart G4), a LOCK Mode comprising time t11–t20, and a HUNT Mode comprising the time between increments beyond t20. At time t0, the difference signal of chart G1 is a −10 mV, indicating, as represented by block 76 in FIG. 6, that the actual operating pressure is substantially less than the Set Operating Pressure. The microprocessor, when it determines this state of conditions, lowers the pad at one-half speed, according to block 85. This increases the actual operating pressure and the difference signal increases to −7 mV, as represented at time t1. Referring then to time t1 on chart G2, which graphically illustrates the movement of the actuator motor 31, the pad is lowered at one-quarter speed. The Stable Timer is not incremented during this period because the difference signal 126 in graph G1 is not yet within the Operating Pressure Range, graphically indicated by the arrow D at the right of G1.

Beginning at time t5, the difference signal jumps to +3 mV and is still outside the Operating Pressure Range, so the Stable Timer (the contents of which are illustrated on chart G3) do not increment. However, the microprocessor raises the pad at one-sixteenth speed, and is represented in graph G2, thereby decreasing the actual operating pressure and eventually, as illustrated at time t6, brings the difference signal to within the Operating Pressure Range D. This commences incrementing the Stable Timer as indicated in chart G3. As long as the difference signal remains within the range D, the Stable Timer continues to increment until it reaches the sensitivity level set by the operator, represented by the level 5 in chart G3, at which time, the system enters into the LOCK Mode as determined by block 106 in FIG. 6.

As long as the difference signal remains within the Operating Pressure Range D for operation in the Lock Mode, the Unstable Timer decremented (although it cannot become negative) as represented by graph G4, for the time increments beginning at t11 and t12. However, for the time increment t13, the pad is lower than desired and the difference signal goes outside the Operating Pressure Range to +4 mV. This causes the Unstable Timer to increment as indicated by graph G4, and this continues, as can be seen by reference to chart G1 until time t16. For the time increment beginning at t16, operation is within the Operating Pressure Range D and the Unstable Timer is decremented. However, for the remainder of the period the difference signal is above the range D and the Stable Time continues to be incremented until it reaches level 5 in chart G4 and the system exits the LOCK Mode and enters the HUNT Mode at time t20, via block 112 in FIG. 6. The HUNT Mode proceeds as described above except that it will be appreciated, for time t26, after the Stable Timer had been incremented for time increments beginning at t23, t24 and t25, the difference signal exceeds the Operating Pressure Range D, and the stable timer (G3) is decremented for two time periods beginning at t26 and t27. Thereafter, the Stable Timer is incremented until the HUNT Mode is again exited.

Having thus disclosed in detail a preferred embodiment of the invention, persons skilled in the art will be able to modify certain of the structure which has been illustrated and to substitute equivalent elements for those disclosed while continuing to practice the principle of the invention; and it is, therefore, intended that all such modifications and substitutions be covered as they are embraced within the spirit and scope of the appended claims.

We claim:

1. In a floor care machine having support wheels and a rotating working unit adapted to engage and treat a floor, improved apparatus for controlling the pressure applied by said unit on said floor, comprising: an actuator carried by said machine for raising and lowering said working unit under control of a controller; an electrical motor driving said working unit in rotation and having a load current; a sensor sensing said load current and generating a signal representative of actual applied pressure of said working unit on said floor; and a controller responsive to said signal of said sensor and stored data entered by an operator and representative of a set operating pressure for said working unit, said controller controlling said actuator to adjust the height of said working unit relative to said floor to render said actual applied pressure substantially equal to said set operating pressure.

2. The apparatus of claim 1 wherein said controller is programmed to lower said working unit when said actual applied pressure is less than said set operating pressure according to predetermined criteria, and wherein said controller controls the speed of said actuator by increasing the speed of said actuator when the difference between said actual applied pressure and said set operating pressure is greater.

3. The apparatus of claim 1 wherein said controller controls the speed of said actuator to raise said working unit when said actual operating pressure is greater than said set operating pressure.

4. The apparatus of claim 3 characterized in that said controller increases the speed of said actuator to adjust the height of said working unit at a faster rate when the difference between said actual operating pressure and said set operating pressure exceeds a predetermined amount.

5. The apparatus of claim 4 wherein said controller operates in a hunt mode to adjust said actual operating pressure to said set operating pressure within an operation pressure range, said apparatus further including data entry means permitting an operator to enter data in said controller representative of a desired set operating pressure, and said controller generates data defining said Operating Pressure Range based on said set operating pressure, said controller including a stable timer and being programmed to decrement said stable timer when said difference between said actual operating pressure and said set operating pressure is outside said operating pressure range, and to increment said stable timer when said difference is within said operating pressure range, said controller being programmed to exit said hunt mode when the contents of said stable timer equal a predetermined quantity.

6. The apparatus of claim 5 wherein said stable timer operating in said hunt mode accumulates data representative of incremental time periods in which said differences between said actual operating pressure and said set operating pressure is determined to be within a predetermined amount.

7. The apparatus of claim 6 wherein said controller exits said hunt mode when the accumulated data content of said stable timer exceeds a predetermined amount.

8. The apparatus of claim 7 wherein said controller further includes a hunt reference register storing data entered by said operator representative of a desired sensitivity, and said controller compares the contents of said stable timer with the contents of said hunt reference register for exiting said hunt mode when the contents of said stable timer indicates that said system has been operating within said operating pressure range to satisfy predetermined criteria, thereby to adjust the sensitivity of said apparatus.

9. The apparatus of claim 8 wherein said controller enters a lock mode when it exits said hunt mode, and further includes an unstable timer storing data in the lock mode representative of accumulated time periods in which the difference between said applied operating pressure and said set operating pressure is within a predetermined range, said controller further including a lock reference register storing operator-entered data representative of a desired sensitivity, said controller being programmed to compare the contents of said unstable timer with the contents of said lock reference register, said controller exiting said lock mode when the difference between the contents of said unstable timer and said lock reference register exceed a predetermined range, said controller thereupon resetting the unstable timer and entering the hunt mode.

10. The apparatus of claim 9 wherein said controller is further programmed to be responsive to signals entered by the operator to adjust the contents of said hunt reference register and thereby adjust the sensitivity of said apparatus operating in the hunt mode of automatic operation, said apparatus characterized in that the greater the contents of said hunt reference register, the longer the system will operate in the hunt mode before entering the lock mode and thereby being more sensitive to variations in operating conditions.

11. The apparatus of claim 10 wherein said controller is further programmed to be responsive to data entered by an operator to change the contents of said lock reference register whereby the sensitivity of said apparatus operating in the lock mode is changed and characterized in that the greater the contents of the lock reference register, the longer the apparatus will operate in the lock mode and thereby be less sensitive to changes in operating conditions.

* * * * *